US007588275B2

(12) United States Patent
Borg

(10) Patent No.: US 7,588,275 B2
(45) Date of Patent: Sep. 15, 2009

(54) COMBINATION MULTIPLE-CANISTER CARRIER AND LIP PROTECTION DEVICE

(75) Inventor: Zakary James Borg, Eugene, OR (US)

(73) Assignee: Oregon Precision Industries, Inc., Eugene, OR (US)

( * ) Notice: Subject to any disclaimer, the term of this patent is extended or adjusted under 35 U.S.C. 154(b) by 367 days.

(21) Appl. No.: 11/717,434

(22) Filed: Mar. 12, 2007

(65) Prior Publication Data

US 2008/0224489 A1 Sep. 18, 2008

(51) Int. Cl.
*B65D 71/00* (2006.01)

(52) U.S. Cl. ..... 294/87.2; 206/151; 206/427; 220/769; 220/796

(58) Field of Classification Search ..... 206/141, 206/145, 147, 151, 158, 159, 427, 428; 294/87.2, 294/87.28, 159; 220/769, 796
See application file for complete search history.

(56) References Cited

U.S. PATENT DOCUMENTS 3,029,935 A * 4/1962 Nolte ..... 206/430
3,199,908 A * 8/1965 Poupitch ..... 294/87.2
3,250,564 A 5/1966 Stern et al.
3,258,288 A * 6/1966 Courter ..... 294/87.2
3,268,070 A * 8/1966 Cunningham ..... 206/150
3,627,121 A 12/1971 Deasy
3,627,123 A 12/1971 Wachter
3,630,350 A 12/1971 Bolton
3,664,497 A * 5/1972 Mascia ..... 206/151
3,669,258 A 6/1972 Mascia
3,751,098 A 8/1973 Owen
D239,437 S 4/1976 Boduch
4,136,772 A 1/1979 Mascia et al.
4,564,106 A 1/1986 Shilcock
4,749,100 A 6/1988 Eberhart
5,105,964 A 4/1992 Heath
5,441,147 A 8/1995 Tanner
5,964,343 A 10/1999 Steiner
6,478,181 B1 11/2002 Bacon et al.
6,520,707 B1 2/2003 Headrick
D502,406 S 3/2005 Eddings

* cited by examiner

*Primary Examiner*—Dean J Kramer
(74) *Attorney, Agent, or Firm*—Chernoff Vilhauer, McClung & Stenzel, LLP

(57) ABSTRACT

A protection device for beaded lips of cans or canisters comprising a planar ring with downwardly projecting flanges with arcuate gaps between flanges, as well as multiples of the same device joined together to form multiple-canister carriers that may be provided with handles such as a pair of finger loops or a single half-loop.

14 Claims, 5 Drawing Sheets

COMBINATION MULTIPLE-CANISTER CARRIER AND LIP PROTECTION DEVICE

BACKGROUND OF THE INVENTION

Canned beverages are often dispensed from vending machines. Of necessity, the interior of such vending machines are of heavyduty construction, typically made of metal. In operation, once the correct amount of money is inserted and a choice of beverage made, a keeper is released, causing the canned beverage to drop into a dispensing bin. Oftentimes the drop is substantial and causes damage to at least one end or to the cylindrical portion of the can. Similarly, such damage can occur during transport from the warehouse to the retail store or to a vending machine. In the typical case of a beverage can that is openable by a pull tab, even minor distortion of the lip or top portion of the can can cause breaks in the pull tab seal, which in turn causes loss of at least some of the can's contents and, if the beverage is carbonated, a considerable mess. There is therefore a need for a device of simple construction that is capable of protecting beverage cans from damage by dampening the shock from dropping them onto a hard surface. This need is met by the present invention.

There is also an ongoing need in the canned container and canister industry for carriers of simple lightweight construction and easy application that are capable of bundling a plurality of cylindrical containers or canisters into a single package to be transported, displayed, stored, stacked or sold as a single unit. These needs are also met by the present invention.

BRIEF SUMMARY OF THE INVENTION

According to the present invention, there is provided a device for protecting annular beaded rims of canisters that snaps on and off the top and/or bottom of them, and that, when joined with one or more other such devices, forms a combination bundler and carrier for multiple canisters having such annular beaded rims.

BRIEF DESCRIPTION OF THE VIEWS OF THE SEVERAL DRAWINGS

DETAILED DESCRIPTION OF PREFERRED EMBODIMENTS

Figure 1:
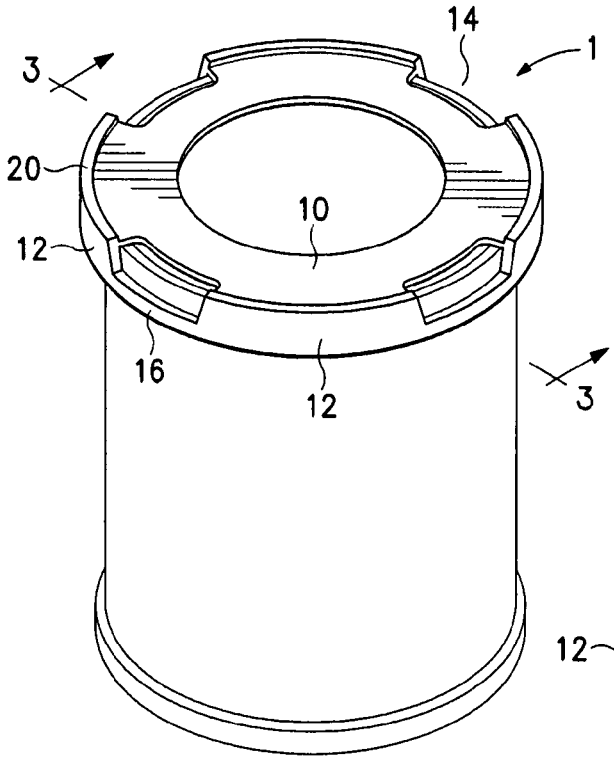
FIG. 1 is a top perspective view of an exemplary container lip protection device of the invention in place over a beaded rim of a canister such as a can.
Figure 2:
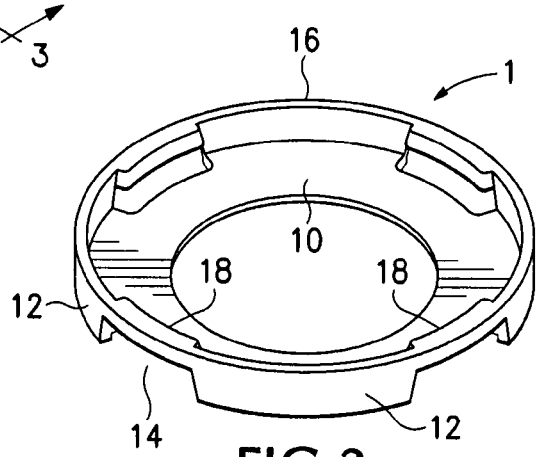
FIG. 2 is a bottom perspective view of the device shown in FIG. 1.
Figure 3:
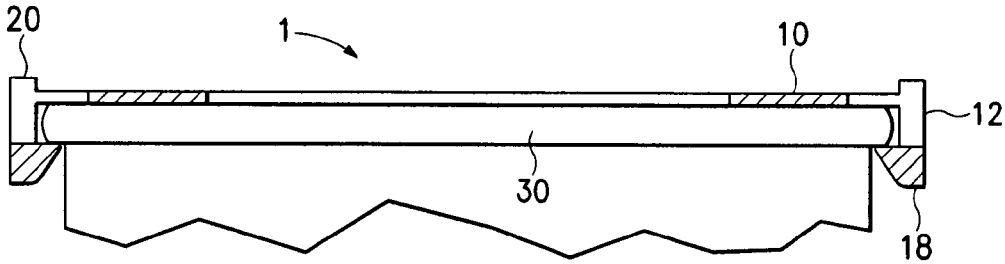
FIG. 3 is a cross-sectional view of the device shown in FIG. 1 taken through the plane 3-3, also in place over a beaded rim of an exemplary canister.

Referring to the drawings, wherein the same numerical references generally refer to like elements, there is shown in FIGS. 1-3, an exemplary device 1 for protecting annular beaded rims of canisters such as cans, filter housings, artillery shells and the like, the device comprising a substantially planar annular ring 10 having a plurality of downwardly projecting flanges 12 with arcuate gaps 14 between adjacent flanges. Each arcuate gap 14 is encompassed on its top side by planar ring 10 and on its bottom side by an arcuate segment 16 connecting adjacent flanges 12, and each arcuate segment 16 in turn is provided with an inwardly extending arcuate lip 18 that is substantially parallel to planar ring 10. Device 1 is also preferably provided with arcuate ribs 20 on the top side of each flange 12, which serve to both reinforce the device and permit nesting of the same for storage, shipment and loading into magazines of automated applicator machinery.

Device 1 is preferably made of a resilient material such as high density polyethylene by injection molding. Use of a resilient material allows arcuate lips 18 to snugly engage the underside of a beaded rim 30 of a canister with spring-like force by simply pressing downwardly in the vicinity of opposing gaps 14 to slightly deform planar ring 10 while pulling corresponding arcuate lips 18 outwardly away from beaded rim 30, then releasing. To release the device from beaded rim 30, the same "press/pull" forces are exerted, followed by separating the device and the canister.

Figure 4:
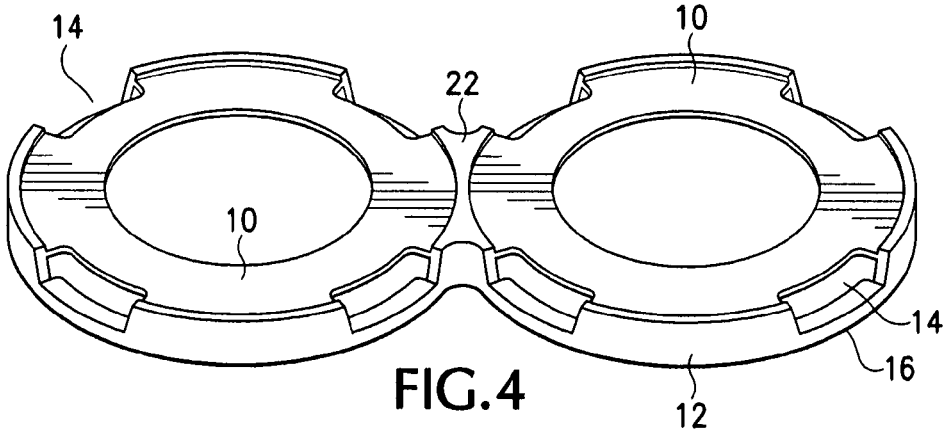
FIG. 4 is a top perspective view of an exemplary carrier of the invention comprising two of the device shown in FIG. 1 joined together.
Figure 5:
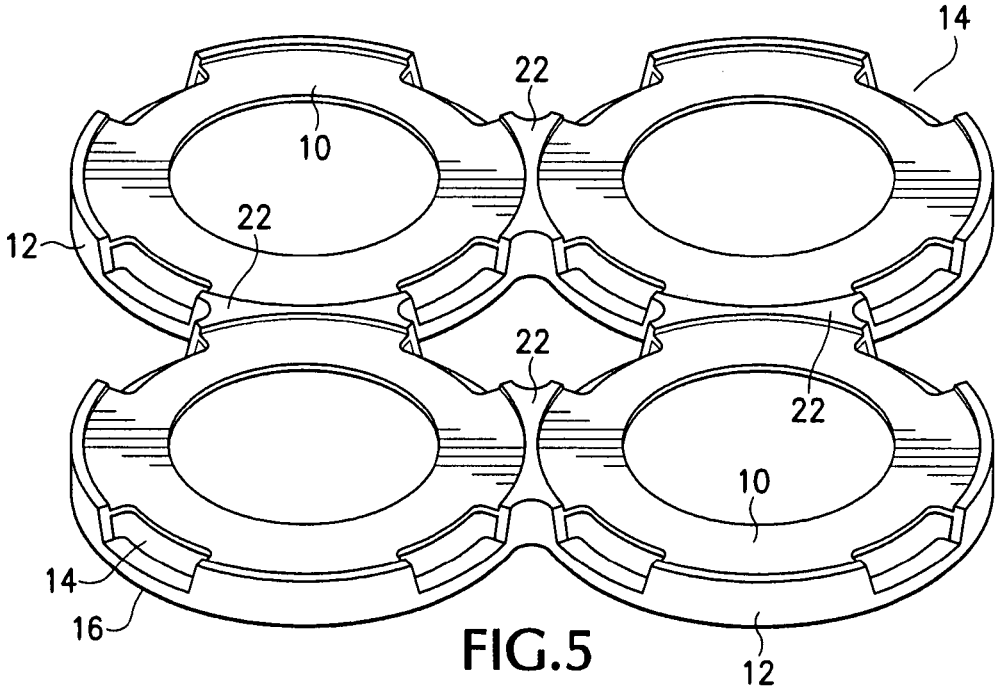
FIG. 5 is a top perspective view of another exemplary carrier of the invention comprising four of the device shown in FIG. 1 joined together.
Figure 6:
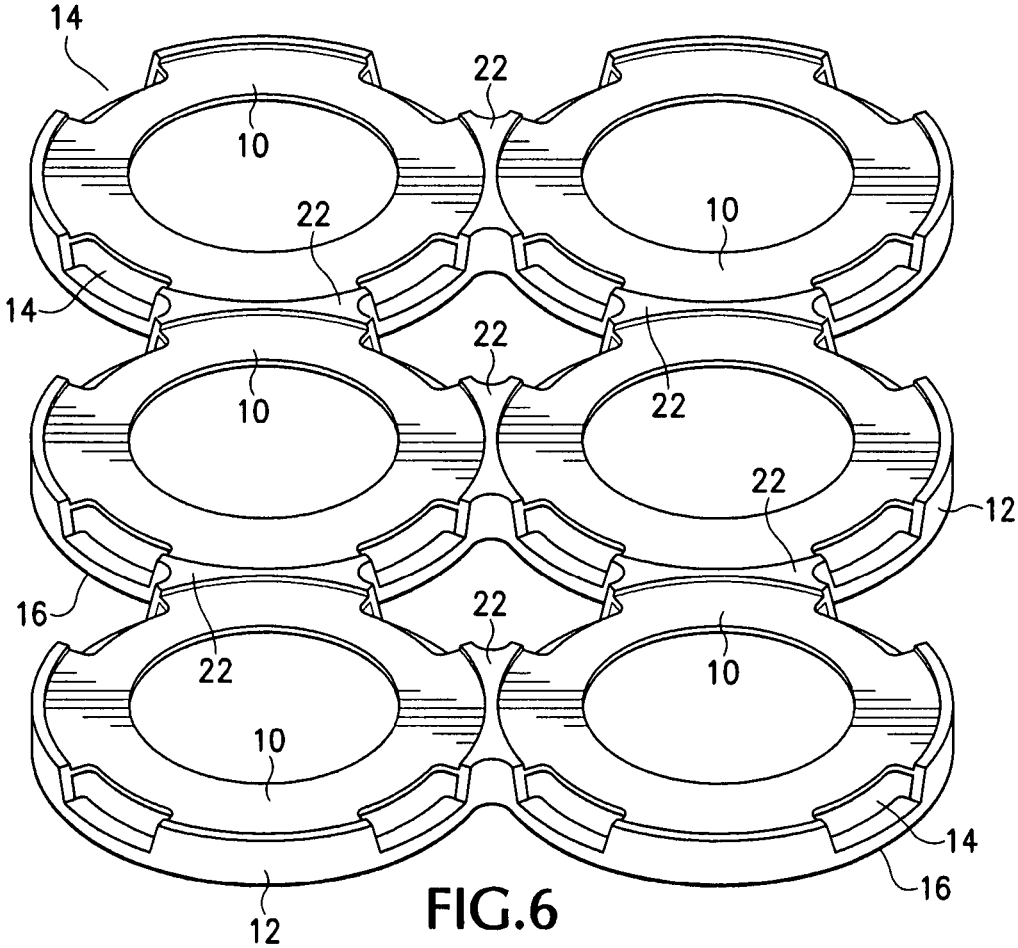
FIG. 6 is a top perspective view of another exemplary carrier of the invention comprising six of the device shown in FIG. 1 joined together.

Multiples of device 1 may be joined together at their peripheries and in substantially the same plane so as to form multiple-canister carriers, as shown in FIGS. 4-6. Such multiple-canister carriers are also preferably made by injection molding. When multiples of device 1 are joined together at their peripheries, the portions corresponding to arcuate ribs 20 in the vicinity of the joinder are preferably fused together "back to back" to form hyperbolic reinforcing elements 22. Elements 22 also facilitate nesting of multiple-canister carriers for storage, shipment, for stacking of sets of multiple containers to which multiples of the device have been applied, and for loading into magazines of automated applicator machinery.

Figure 7:
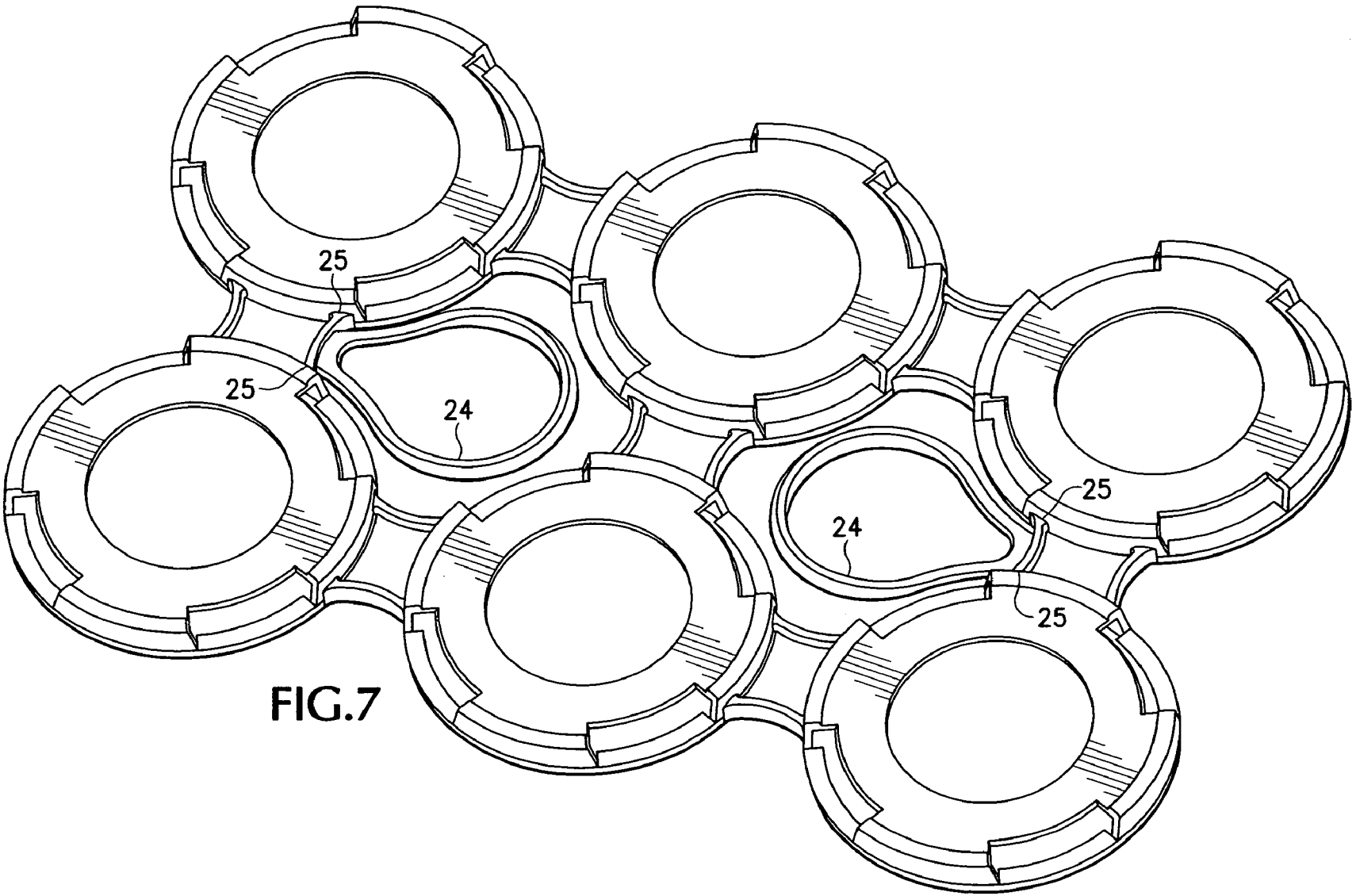
FIG. 7 is a top perspective view of the carrier of FIG. 6 provided with finger loops to act as a carrying handle.
Figure 9:
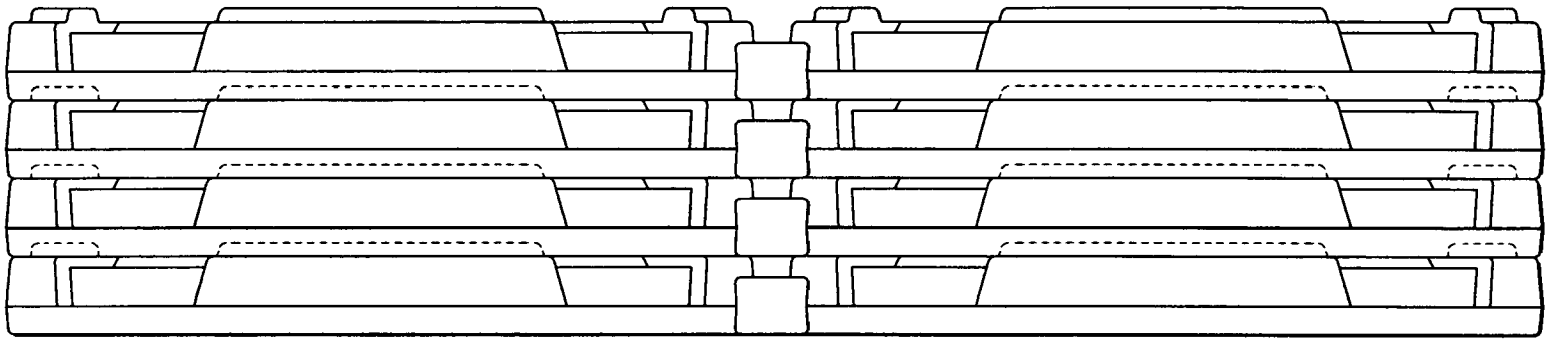
FIG. 9 is a partial side view of a nested stack of multiple carriers of the type shown in FIGS. 7-8.
Figure 10:
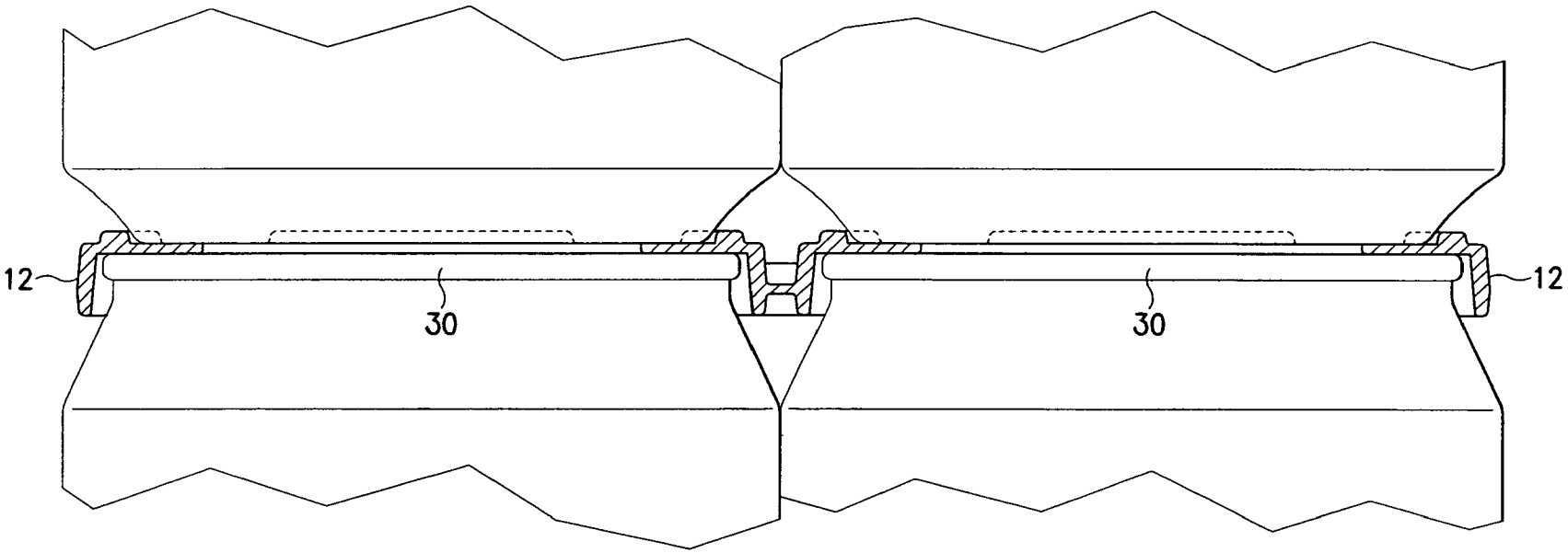
FIG. 10 is a partial side view of the carrier applied to the rims of canisters with additional bundled canisters stacked atop.

As shown in FIG. 7, multiple-canister carriers of the type shown in FIG. 6 may be provided with carrying handles in the form of finger loops 24, flexibly attached at points 25 that are proximal or nearest to the four outermost annular rings 10. Loops 24 normally lie in substantially the same plane of the multiple canister carrier, thereby permitting efficient nesting of the carriers, as seen in FIG. 9, and stacking of bundles of canisters to which the carriers have been applied, as seen in FIG. 10. But when grasped for carrying, loops 24 pivot upwardly away from the plane of the multiple canister carrier by virtue of gravitational pull on canisters to which annular rings 10 have been applied.

Figure 8:
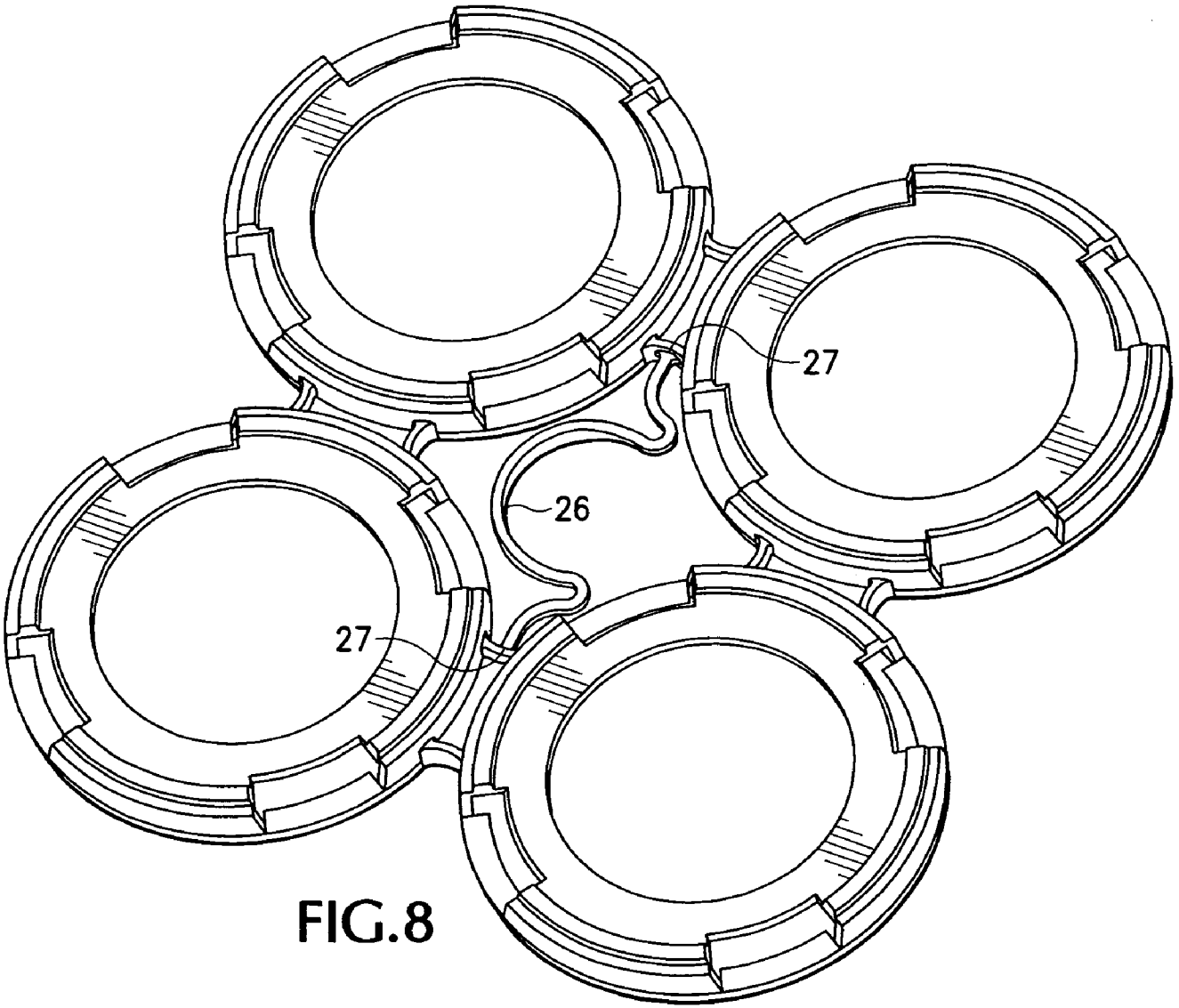
FIG. 8 is a top perspective view of the carrier of FIG. 5 provided with a finger loop to act as a carrying handle.

As seen in FIG. 8, multiple-canister carriers of the type shown in FIG. 5 may also be provided with a carrying handle in the form of a single U-shaped half-loop 26 flexibly attached at balance points 27. As with the case of finger loops 24, half-loop 26 normally lies in substantially the same plane of the multiple-canister container to permit efficient nesting of the carriers and stacking of bundles of canisters to which the carriers have been applied, but pivot upwardly away from that plane when grasped for carrying.

The device and multiples thereof may be applied to any manner of cylindrical containers or canisters bearing annular beaded rims on their tops and/or bottoms, such as food cans, beverage cans, filter housings, bullet casings, artillery shells and other ordinance packaged in canisters.

The terms and expressions which have been employed in this specification are used as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A device for protecting annular beaded rims of canisters comprising a substantially planar ring with a plurality of downwardly projecting flanges with arcuate gaps between adjacent flanges, each of said arcuate gaps having a top side and a bottom side, each of said gaps being bordered on its top side by said planar ring and on its bottom side by an arcuate segment connecting adjacent flanges, said arcuate segment having an inwardly extending arcuate lip substantially parallel to said planar ring.

2. The device of claim 1 made of resilient material.

3. The device of claim 2 wherein said resilient material is high density polyethylene.

4. A carrier for multiple canisters having annular beaded rims comprising a plurality of the device of claim 3 joined together at their peripheries and in substantially the same plane.

5. The carrier of claim 4 wherein said plurality is two.

6. The carrier of claim 4 wherein said plurality is four.

7. The carrier of claim 4 wherein said plurality is six.

8. The carrier of any of claims 4-7 including a handle.

9. The carrier of claim 8 wherein said handle comprises two finger loops.

10. The carrier of claim 9 attached to multiple canisters.

11. The carrier of chain 8 wherein said handle comprises a substantially U-shaped half-loop.

12. The carrier of claim 11 attached to multiple canisters.

13. The carrier of claim 8 attached to multiple canisters.

14. The carrier of any of claims 4-7 attached to multiple canisters.

* * * * *